US010287838B2

(12) United States Patent
Van Bilderbeek et al.

(10) Patent No.: US 10,287,838 B2
(45) Date of Patent: May 14, 2019

(54) RUNNING TOOL

(71) Applicant: Plexus Holdings, PLC., Aberdeen (GB)

(72) Inventors: Bernard Herman Van Bilderbeek, London (GB); Michael Robertson, Aberdeenshire (GB); Craig Francis Bryce Hendrie, Aberdeenshire (GB); Mark Bridges, Aberdeenshire (GB)

(73) Assignee: Plexus Holdings, PLC., Aberdeen (GB)

( * ) Notice: Subject to any disclaimer, the term of this patent is extended or adjusted under 35 U.S.C. 154(b) by 91 days.

(21) Appl. No.: 14/914,927

(22) PCT Filed: Sep. 1, 2014

(86) PCT No.: PCT/GB2014/052643

§ 371 (c)(1),
(2) Date: Feb. 26, 2016

(87) PCT Pub. No.: WO2015/028826

PCT Pub. Date: Mar. 5, 2015

(65) Prior Publication Data

US 2016/0222748 A1 Aug. 4, 2016

(30) Foreign Application Priority Data

Sep. 2, 2013 (GB) ..... 1315592.4

(51) Int. Cl.
*E21B 33/04* (2006.01)
*E21B 23/04* (2006.01)

(52) U.S. Cl.
CPC ..... *E21B 33/04* (2013.01); *E21B 23/04* (2013.01)

(58) Field of Classification Search
CPC ..... E21B 33/04; E21B 33/043
(Continued)

(56) References Cited

U.S. PATENT DOCUMENTS 3,081,113 A * 3/1963 Haeber ..... E21B 33/035 285/23
4,634,152 A * 1/1987 Pettit ..... E21B 33/043 285/39

(Continued)

FOREIGN PATENT DOCUMENTS

GB 1231376 9/1969

OTHER PUBLICATIONS

Search Report, GB1315592.4, dated Feb. 10, 2014, 1 pg.
Search Report, PCT/GB2014/052643, dated Jul. 7, 2015, 4 pgs.

*Primary Examiner* — Kenneth L Thompson
(74) *Attorney, Agent, or Firm* — Egan Peterman Enders Huston

(57) ABSTRACT

The present invention provides a running tool 10 for a casing hanger 12 in which the casing hanger 12 is arranged to be clamped within a well bore. In the clamped position, the suspension weight of the casing hanger 12 (and suspended) casing string is supported by the wellhead and the running tool 10 is then releasable from the casing hanger 12. The release of the running tool 10 from the casing hanger 12 is performed by applying an axial pressure down the running tool 10 which then enables the securement means 30 of the running tool 10 to be moved into an unsecured position. In the secured position, the casing hanger 12 is suspendable from the running tool 10 and the running tool 10 supports the suspension weight of the casing hanger 12 (and the casing string located there below). The running tool 10 comprises activation means 40 in order to enable the securement means 30 to move from the secured position to the unsecured position. The running tool 10 includes release prevention means 50 in order to prevent the movement of the securement means 30 from the secured position to the unsecured
(Continued)

position whilst the suspension weight of the casing hanger 12 is suspended from the running tool 10.

13 Claims, 2 Drawing Sheets

(58) Field of Classification Search
USPC ..... 166/378, 75.14, 368
See application file for complete search history.

(56) References Cited

U.S. PATENT DOCUMENTS

| | | | | | |
|---|---|---|---|---|---|
| 4,712,621 | A | * | 12/1987 | Wightman et al. ... | E21B 33/043 166/382 |
| 4,736,799 | A | | 4/1988 | Ahlstone | |
| 4,969,516 | A | * | 11/1990 | Henderson et al. .. | E21B 33/043 166/182 |
| 5,145,006 | A | | 9/1992 | June | |
| 6,302,211 | B1 | * | 10/2001 | Nelson ..... | E21B 23/01 166/338 |
| 6,516,876 | B1 | | 2/2003 | Jennings | |
| 7,096,956 | B2 | * | 8/2006 | Reimert ..... | E21B 23/04 166/339 |
| 8,276,671 | B2 | * | 10/2012 | Neto et al. ..... | E21B 33/043 166/348 |
| 8,286,711 | B2 | * | 10/2012 | Neto ..... | E21B 33/04 166/123 |
| 8,567,493 | B2 | * | 10/2013 | June ..... | E21B 23/00 166/208 |
| 2008/0017386 | A1 | | 1/2008 | Van Bilderbeek | |

* cited by examiner

RUNNING TOOL

This Application is a national stage of PCT/GB2014/052643 filed Sep. 1, 2014, and published in English, which claims priority to United Kingdom Patent Application 1315592.4 (GB) filed on Sep. 2, 2013.

FIELD OF THE INVENTION

The present invention relates to a running tool for use with a casing hanger, an arrangement comprising a running tool and a casing hanger and a method of running a casing hanger.

BACKGROUND TO THE INVENTION

Casing hangers are used in oil and gas drilling to suspend casing strings within the wellhead and facilitate the use of an annulus seal between the casing string and the wellhead bore. Annulus seals are the devices that seal the annulus spaces between casing and tubing strings. The present invention relates to an improved casing hanger running tool for use with a casing hanger and wherein the casing hanger is arranged to be secured by an arrangement which is independent of the running tool, such as a clamping arrangement.

Conventional land platform or subsea wellheads use annular seals that are either elastomeric or metal to metal seals. Elastomeric seals are energised by an initial setting squeeze on the elastomer and most metal to metal seals are energised by pushing a sealing element over a taper to expand the seal element until it contacts the wellhead bore and/or hanger outer diameter. These annular seal elements are generally run in conjunction with a casing hanger by means of a casing hanger running tool which also provides the energising force required to set the annular seal via rotation or with pressure assistance. The seals may be an integral feature on the casing hanger and are energised by radially compressing the wellhead housing inwardly in order to squeeze the seal element on the outer diameter casing hanger.

The running tool is released from the casing hanger by rotation of the tool stem relative to the casing hanger. This then enables the running tool to be extracted and removed from the well. The casing hanger running tool is generally required to run or set the annulus seal within the well as well as carrying the casing hanger. Alternatively, the annular seal can be installed as a separate operation, which may be simpler but takes more time.

It is an aim of the present invention to overcome at least one problem associated with the prior art whether referred to herein or otherwise.

SUMMARY OF THE INVENTION

According to a first aspect of the present invention there is provided a running tool for a casing hanger, the running tool comprising:

securement means to secure a casing hanger to the running tool, the securement means being movable between a secured position in which a casing hanger is secured to the running tool and an unsecured position in which a casing hanger is unsecured to the running tool; wherein, in the secured position, a casing hanger is suspendable from the running tool and the running tool supports a suspension weight of the casing hanger;

activation means in order to enable the securement means to move from a secured position to an unsecured position, wherein the activation means is axially moveable between the secured position and the unsecured position; and release prevention means in order to prevent the movement of the securement means from the secured position to the unsecured position whilst the suspension weight of the casing hanger is suspended from the running tool.

Preferably the securement means projects radially outwardly from the running tool. The securement means may project radially outwardly from a body of the running tool.

Preferably the securement means is radially moveable between the secured position and the unsecured position. Preferably the securement means is radially moveable from an outer (secured) position to an inner (unsecured) position.

Preferably the securement means is arranged to be locked in the secured position and more preferably the securement means is arranged to be locked in an outer radial position. Preferably in the secured position the securement means is prevented from moving to the unsecured position. Preferably in the secured position the securement means is prevented from moving radially inwardly.

Preferably the activation means is arranged to prevent movement of the securement means from the secured position to the unsecured position and may lock the securement means in a radially projecting position relative to an outer surface of the running tool.

The securement means may comprise a securement member which may comprise an annular securement member. The securement member may comprise a locking ring.

The securement member may provide an outer engaging surface (or engagement flange) which is arranged to engage in a corresponding engagement groove provided in the casing hanger. Preferably the casing hanger provides an engagement groove in an inner surface.

Preferably the securement means is retained in the secured position by thrust means or urging means. Preferably the securement means is retained in the secured position by bias means.

The thrust means may comprise thrust pins. The thrust pins may be arranged to bear against the activation means. Preferably the activation means retains the thrust means in the secured position.

The activation means may provide a recess. The recess may enable the securement means to move from the secured position to the unsecured position.

Preferably the recess is axially moveable in the running tool. Preferably the recess is axially moveable from a secured position at which the thrust means bears against the activation means to an unsecured position at which the thrust means is moveable into the recess and/or the securement member is radially inwardly moveable.

Preferably the activation means is activated by pressure applied to the running tool. Preferably the activation means is activated by a (downward) axial pressure applied to the running tool. Preferably the downward pressure is applied by a fluid located in an annulus located on the upper side if the running tool.

The activation means may be axially moveable along the longitudinal axis of the well bore. The activation means may be moveable along the longitudinal axis of the running tool and/or the well bore and/or the riser.

The pressurised fluid may be introduced into the annulus and preferably is introduced through choke lines. The choke lines may locate above the running tool and below a blow out preventer. The fluid may comprise drilling mud.

Preferably the recess is axially alignable with the securement member to enable the securement member to move from the secured position to the unsecured position.

The activation means may comprise a sleeve member which is axially moveable in the running tool. The sleeve member may comprise a collet. Preferably the collet is axially moveable from a secured position to an unsecured position.

The recess may be provided on the collet and preferably the recess is provided on an outer surface of the collet. The recess may comprise a groove and preferably comprises an annular groove or a peripheral groove provided on an outer surface of the collet.

The activation means may comprise a piston. The piston may comprise a sleeve member. The piston may be secured to the collet. Preferably the piston is arranged to (axially) move the collet from the secured position to the unsecured position.

The activation means may comprise retaining means to prevent axial movement of the activation means within the running tool. Preferably the retaining means prevents axial movement of the piston and/or the collet and/or the recess.

The retaining means may comprise a plurality of retaining members. The retaining members may comprise shear pins. The shear pins may be arranged to shear to enable axial the activation means to move from the secured position to the unsecured position. The shear pins may be arranged to shear in reaction to a pressure applied to the running tool and more preferably in reaction to a fluid pressure applied within an annulus located on an upper side (or first side) of the running tool.

The shear pins may extend radially inwards. Preferably the shear pins extend radially inwards and project into the activation means and a body of the running tool.

The running tool may provide an annular gap or space into which the activation means is moveable to provide the unsecured position. The annular gap may enable a lower end of the activation means to locate therein. The annular gap may enable a lower end of the collet to locate therein.

The release prevention means may be arranged to prevent unintentional activation of the activation means. The release prevention means may be arranged to prevent release of the casing hanger prior to the casing hanger being secured within a well bore. Preferably the release prevention means prevents the release of the casing hanger prior to the clamping of the casing hanger within a well bore.

The release prevention means may comprise abutment means to prevent movement of the activation means from the secured position to the unsecured position whilst the casing hanger is supported from the running tool and the suspension weight of the casing hanger may be being transferred to the running tool.

Preferably the release prevention means comprises abutment means to prevent axial movement of the activation means to the unsecured position. Preferably the abutment means prevents the movement of the recess into axial alignment with the securement member.

The abutment means may comprise a shoulder which may be provided on the activation means. The shoulder may be provided on the collet. Preferably the shoulder comprises an annular shoulder which projects inwardly from the collet.

The abutment means may comprise a shoulder which may be provided on a body of the running tool. The shoulder may project radially outwardly from the body. The shoulder may comprise an annular shoulder which projects outwardly from the body of the running tool.

The abutment means may comprise an abutment shoulder on the collet and a corresponding abutment shoulder on a body of the running tool.

The running tool may comprise auxiliary release means to activate the release of the casing hanger from the running tool.

The auxiliary release means may comprise anti-rotation means to prevent rotation between the running tool and the casing hanger. The auxiliary release means may comprise a rotatable member on the running tool which is rotatable in order to cause the axial movement of the activation means from the secured position to the unsecured position.

The running tool may comprise mounting means to enable the running tool to be mounted to an (elongate) running member. The running member may comprise a drill pipe.

According to a second aspect of the present invention there is provided an assembly comprising a running tool and a casing hanger, the running tool comprising:

securement means to secure the casing hanger to the running tool, the securement means being movable between a secured position in which the casing hanger is secured to the running tool and an unsecured position in which the casing hanger is unsecured to the running tool; wherein, in the secured position, the casing hanger is suspendable from the running tool and the running tool supports a suspension weight of the casing hanger;

activation means in order to enable the securement means to move from a secured position to an unsecured position wherein the activation means is axially moveable between the secured position and the unsecured position; and release prevention means in order to prevent the movement of the securement means from the secured position to the unsecured position whilst the suspension weight of the casing hanger is suspended from the running tool.

According to a third aspect of the present invention there is provided a method of positioning a casing hanger within a well bore, the method comprising securing a running tool to the casing hanger wherein the running tool comprises:

securement means to secure a casing hanger to the running tool, the securement means being movable between a secured position in which a casing hanger is secured to the running tool and an unsecured position in which a casing hanger is unsecured to the running tool; wherein, in the secured position, a casing hanger is suspendable from the running tool and the running tool supports a suspension weight of the casing hanger;

activation means in order to enable the securement means to move from a secured position to an unsecured position wherein the activation means is axially moveable between the secured position and the unsecured position; and release prevention means in order to prevent the movement of the securement means from the secured position to the unsecured position whilst the suspension weight of the casing hanger is suspended from the running tool;

the method comprising releasing the running tool from the casing hanger by axially moving the activation means.

BRIEF DESCRIPTION OF THE DRAWINGS

The present invention will now be described, by way of example only, with reference to the drawings that follow, in which.

DESCRIPTION OF THE PREFERRED EMBODIMENTS

Figures 1, 2:
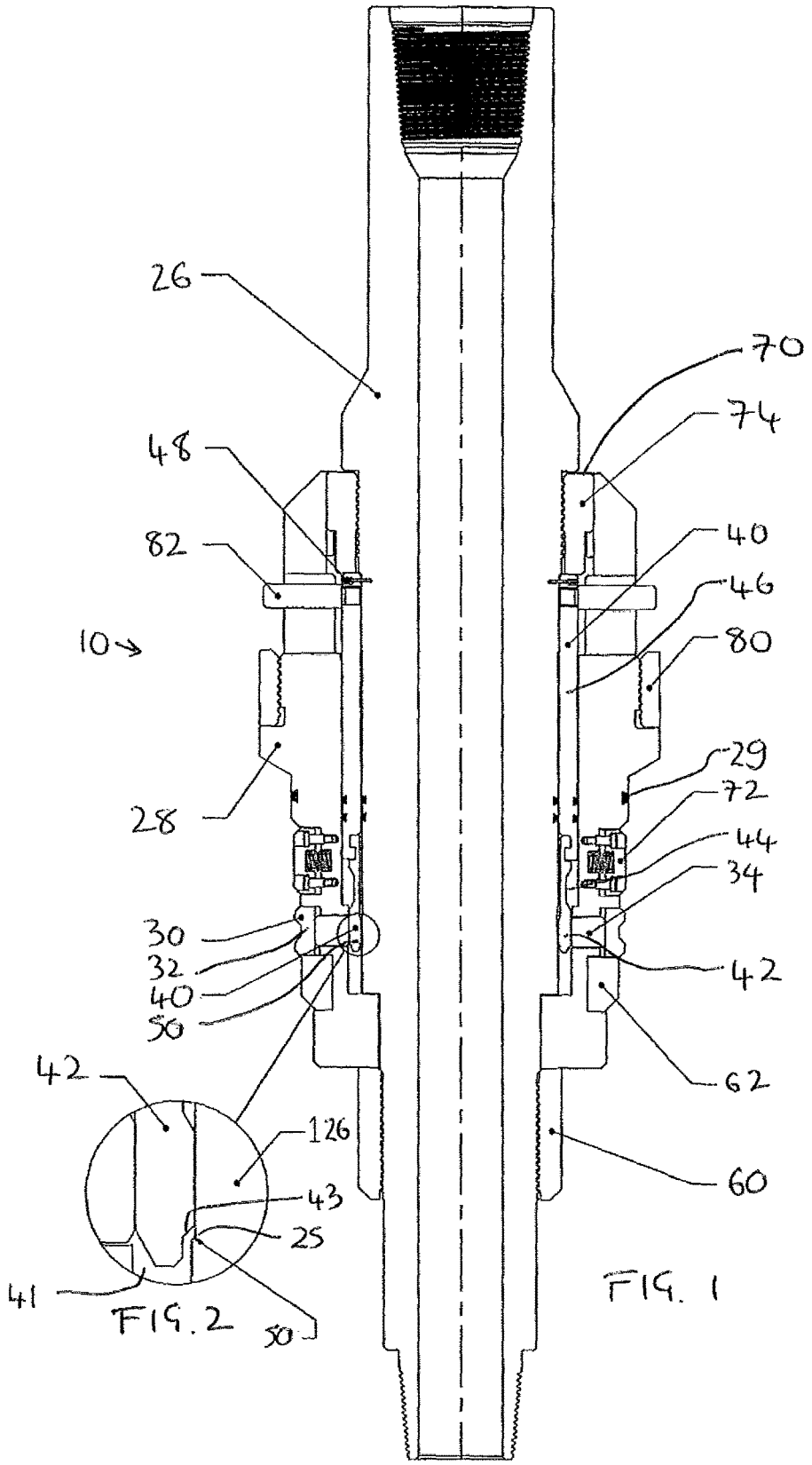
FIG. 1 is a cross section of a preferred embodiment of a running tool in accordance with the present invention.
FIG. 2 is a detailed cross section of a release prevention means of a preferred embodiment of a running tool in accordance with the present invention.

The present invention provides a running tool 10 for a casing hanger 12 in which the casing hanger 12 is arranged to be clamped within a well bore. In the clamped position, the suspension weight of the casing hanger 12 (and suspended) casing string is supported by the wellhead and the running tool 10 is then releasable from the casing hanger 12. The release of the running tool 10 enables the well to then be completed.

The running tool 10 of the present invention does not require any relative rotation between the running tool 10 and the casing hanger 12 in order to release the running tool 10 from the casing hanger 12.

The present invention is for use with a wellhead clamping arrangement 22 which clamps the casing hanger 12 within the well and this clamping step transfers the suspension weight of the casing hanger 12 from the running tool 10 to the wellhead 11. Once the suspension weight is not supported from the running tool 10, the running tool 10 becomes releasable form the casing hanger 12.

Prior to the transfer of the suspension weight from the running tool 10 to the wellhead 11, the release system of the running tool 10 is prevented from operating. This prevents the running tool 10 from being inadvertently released as the running tool 10 is moving the casing hanger 12 into position.

The release of the running tool 10 from the casing hanger 12 is performed by applying a pressure in the annulus between tool 10 and the wellhead bore 16 which forces the components, collet 42 and piston 46, to move axially to a position where the securement means 30 of the running tool 10 can be moved into an unsecured position. The securement means 30 secures the casing hanger 12 to the running tool 10 and the securement means 30 is movable between a secured position in which the casing hanger 12 is secured to the running tool 10 and an unsecured position in which the casing hanger 12 is unsecured to the running tool 10. In the secured position, the casing hanger 12 is suspendable from the running tool 10 and the running tool 10 supports the suspension weight of the casing hanger 12 (and the casing string located there below).

The running tool 10 also comprises activation means 40 in order to enable the securement means 30 to move from the secured position to the unsecured position.

The running tool 10 includes release prevention means 50 in order to prevent the movement of the securement means 30 from the secured position to the unsecured position whilst the suspension weight of the casing hanger 12 is suspended from the running tool 10.

Figure 3:
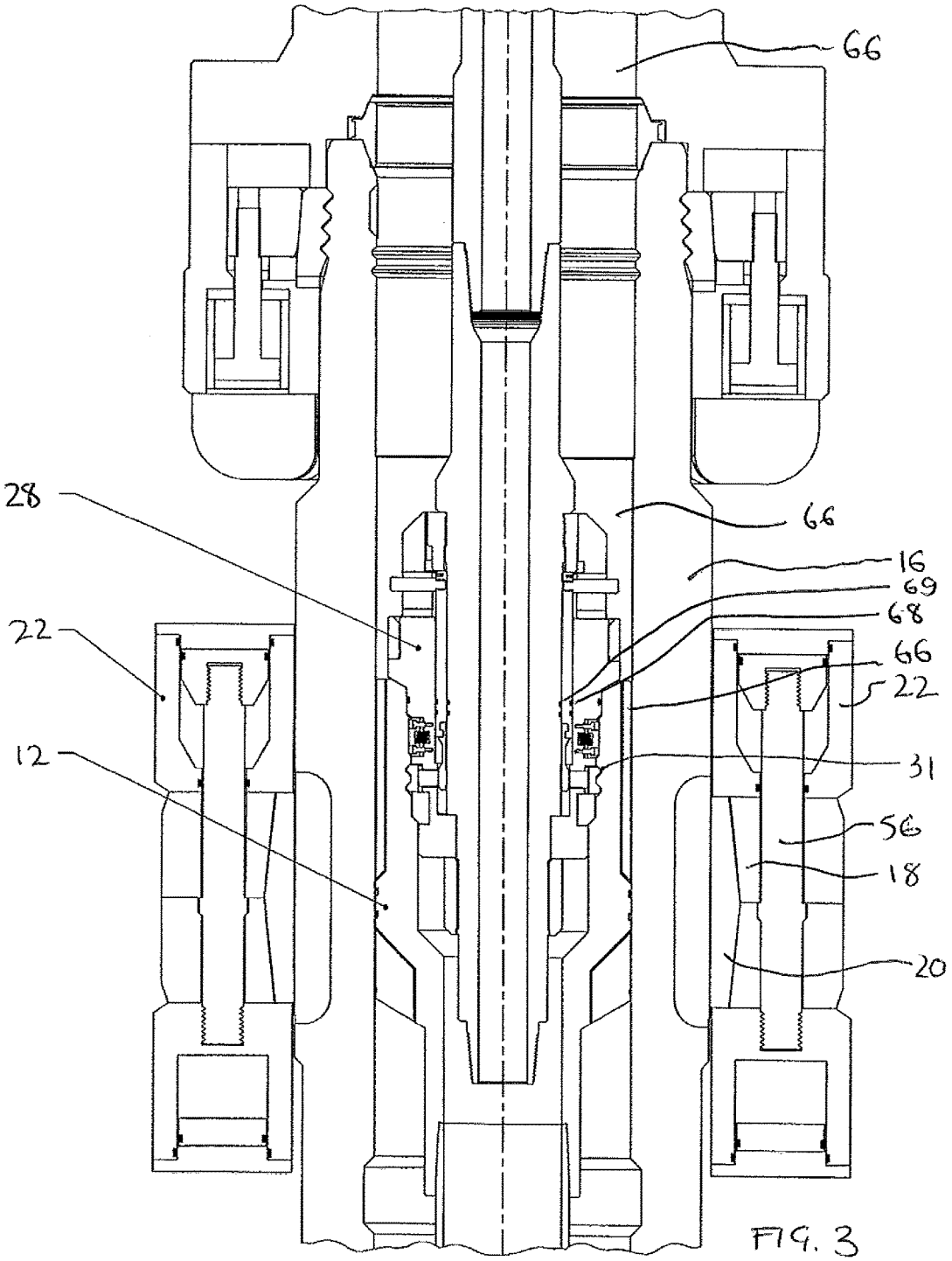
FIG. 3 is a cross section of a preferred embodiment of a running tool secured to a casing hanger with the casing hanger being clamped within a wellhead.

The basic operation of the running tool 10 as described above will now be described in more detail with reference to a preferred embodiment of the running tool 10 as shown in FIG. 1, FIG. 2 and FIG. 3.

The running tool is for use with locating a casing hanger in a wellhead 11 which incorporates a clamping arrangement 22 for clamping the casing hanger 12 and the casing string therein. The wellhead 11 incorporates the clamping arrangement 22 whereby an outer member 16 is arranged to be deflected radially inwardly in order to grip and secure the casing hanger 12 within the bore of the outer member 16. Such a clamping arrangement is available from Plexus Holdings plc under the trade mark POS-GRIP.

In the embodiment shown in FIG. 3, the clamping arrangement 22 comprises a compression ring 18 or an upper and a lower ring. The compression ring 18 has inner tapered surfaces which are arranged to co-operate with tapered surfaces provided on a collar 20. The compression ring 18 is in two parts (an upper ring and a lower ring). The upper ring can be moved relatively towards the lower ring in order to produce an inwardly directed radial force on the collar 20. The collar surrounds an outer circumference of the outer wellhead member 16. In particular, the collar 20 locates around a clamping zone 19 of the outer member 16. This clamping zone 19 may comprise a series of axially extending slots and flanges which thereby facilitates inward deflection/movement of the outer member 16 in reaction to the inward compression force generated by the collar 20.

The compression ring 18 thereby forces the wall of the outer member 16 inwardly. The outer wellhead member 16 comprises an inner clamping surface 17 which, on contraction, is arranged to grip and clamp a corresponding outer clamping surface 15 of the casing hanger 12. The force is increased until the required clamping force is achieved and, at this point, the casing hanger 12 is securely clamped within the outer member 16. In this clamping arrangement 22, the casing hanger 14 can be released and re-clamped, if required.

This invention could also be used in a "Type 1" POS-GRIP compression system, or a POS-GRIP connector, or any other system where the casing hanger is secured into the wellhead independently from the functions of the running tool.

As shown in FIG. 1, the pressure release casing hanger running tool 10 is in the secured or locked position but for clarity purposes the running tool 10 is not secured or made up to the casing hanger 12. In the primary application of this invention, the casing hanger running tool 10 will be made up to a casing hanger 12, and positioned in a wellhead housing, as shown in FIG. 3. This invention is deployed on a drill pipe 24 made up to the tool stem 26.

The main body 28 is held in place on the stem 26 by a retaining ring 60 and the body 28 has an external elastomeric seal 29 that will seal in the bore of the casing hanger 12. In order to secure and lock the running tool 10 into the casing hanger 12, the running tool 10 has securement means comprising a securement member in the form of a profiled lock ring 32 that locates within a mating profile 33 within the casing hanger 12. The lock ring 32 is moved from the locked to the unlocked position by virtue of the position of activation means comprising a collet 40. The collet 40 is axially slidably moveable within the running tool 12. The collet 40 provides a recess 44 into which a part of the securement means 30 can move when the recess 44 is radially aligned with the recess 44. In this configuration, the part of the securement means moves into the recess and the lock ring moves radially inwardly.

In the locked position, the recess 44 is axially spaced from an inner surface of the securement means 30. In order to unlock and release the running tool 10, the recess 44 is moved axially downwardly in order to be radially aligned with an inner surface 35 of the securement means 30. In this position, the securement means 30 is moveable radially inwardly and this enables the lock ring 32 to move radially inwardly and out of engagement with the mating profile 31 provided in the inner surface 31 of the casing hanger 12. This releases the running tool 10 and then enables the running tool 10 to be extracted from the well.

The securement means 30 comprises the securement pins or thrust pins 34 which provide the inner surface 35 of the securement means. In particular, the thrust pins provide the link between the collet 42 (activation means 40) and the lock ring 32 (securement means 30).

The configuration of the securement means ensures that any weight suspended from the casing hanger 12 is transferred through the lock ring 32 into a load member comprising a load ring 62.

When the casing hanger 12 is in the set position, external compression of the outer member 16 (which may be provided by a POS-GRIP compression system 22 as shown in FIG. 3) brings an inner clamping surface 17 of the wellhead bore and the outer diameter 15 of the casing hanger 12 outside diameter into contact. The contact pressure along this interface forces the outer member 16 and the casing hanger 12 to be concentric and this activates metal-to-metal 'HG' seals. Once activated, there is sufficient contact load to provide pressure integrity, hanging/lockdown capacity and the desired conditions for the release of the casing hanger running tool 10.

A key feature of the invention is that the application of pressure from above the running tool 10 will allow the running tool 10 to be released from the casing hanger 12 due to the pressure end load exerted on an activation member 46 of the activation means 40. The activation member 46 comprises a piston 46 which is connected to the collet 42.

The activation means is axially moveable along the longitudinal axis of the well bore. In particular, the activation means is moveable along the longitudinal axis of the running tool 10 and the well bore and/or the riser.

The activation means 40 is retained to the stem 26 by retaining means in the form of a plurality of retaining members 48. The retaining members 48 comprise shear pins which extend radially into the stem 26 and prevent relative axial movement of the activation means within the running tool. In particular, the shear pins 48 prevent the piston 46 and the collet moving axially downwardly and this prevent the recess 44 from moving into axial alignment with the inner surface 35 of the thrust pins 34.

Once the required release pressure has been applied above the activation means/running tool, the shear pins 48 will shear to allow the piston 46 and the collet 42 to move axially downwards. This axial movement enables and permits the thrust pins 34 and the lock ring 32 to retract and consequently disengage from the casing hanger 12. The running tool 10 can then be removed from the casing hanger 12.

The activation of the securement means 30 in order to move the securement means 30 from the secured position to the unsecured position comprises a fluid pressure. In particular, the pressure in the annulus 66 above the activation means 40 is increased to trigger the unsecurement (or release) of the running tool 10. The release and activation pressure is applied in the annulus 66 between the drill pipe 24 and wellhead bore. This is typically done by closing the blow out preventer (BOP) rams on the drill pipe (well above the area shown in the figures) and applying fluid pressure (drilling mud) through the choke lines which are typically connected to the riser just below the BOP. Annulus fluid pressure acts on sleeve 46 (due to the differential pressure between the seals 68 and 69). The sleeve 46 shears the pins 82 and moves axially downwards pushing the collet 42 into a position where the locking dog assemblies 30, 32, 34 can move radially inwards to the release position. Once the pressure is bleed off, the running tool 10 can be removed with a straight pull up.

In order to prevent the premature release of the casing hanger 12 from the casing hanger running tool 10 whilst being run in hole (for example, due to an unexpected build up of pressure) release prevention means 50 comprising an anti-release feature has been designed into the running tool 10.

As shown in FIG. 1 and FIG. 2, the tool stem 26 has a small load shoulder 25 profile that will restrict movement of the collet 42 into the release position whilst casing weight (suspension weight of the casing hanger) is present. The collet 42 also comprises a corresponding small load shoulder 43 which is arranged to abut and engage the load shoulder 25 of the tool stem 26. These load shoulders 25, 43 prevent the movement of the collet 42 into an annular gap 41 provided in the running tool 10. The location of the collet 42 in this annular gap 41 provides the unsecured position since this corresponds to the recess 44 being radially axially aligned with the inner surfaces 35 of the thrust pins 34.

The release prevention means 50 operates due to the casing weight below the casing hanger 12 transferring load via the lock ring 32 to push the thrust pins 34 inwards and in turn crimp the collet 42 onto the stem 26. The small load shoulder 25 then provides a stop to restrict the movement of the collet 42 and consequently prevent premature release of the casing hanger 12.

Once the casing hanger 12 is located in place and is holding all the casing weight (suspension weight of the casing hanger) the running tool 10 can be released as the collet 42 is now free to expand over the small load shoulder 25. The pressure applied by the drill pipe 24 will cause the shear pins 48 to shear and for the piston 46 to move axially downwardly. The piston 46 which is secured to the collet 42 thereby moves the collet downwardly with the collet 42 moving over the load shoulder 25 of the tool stem 26. The collet 42 moves axially into the annular gap 41 and the release recess 44 in the form of an annular groove in the collet 44 moves into axial alignment with the inner surface 35 of the thrust pins 34. In this position, the lock ring moves radially inwardly and disengages with the mating profile 31 in the inner surface of the casing hanger 12. The running tool 10 can then be extracted from the casing hanger 12 and retrieved from the well by the drill pipe 24.

Should there be a failure in the use of pressure to release the running tool 10 from the casing hanger 12 then there is a mechanical contingency feature in the form of an auxiliary release means 70. The auxiliary release means 70 comprise a plurality of anti-rotation keys 72 on the body 28 of the running tool 10 that locate and react against the inside of the casing hanger 12. A threaded drive ring 74 can be wound axially downwardly against the piston 46 by means of rotation of the stem 26 to release the running tool 10.

A setting ring 80 and piston drive pins 82 are used to manipulate the piston 46 into the desired position when the running tool 10 is being made up to the casing hanger 12.

FIG. 3 shows one possible configuration for this invention in a wellhead system. The main components of this system are a "Type-2" POS-GRIP compression system 22 that may be part of a wellhead housing, and a casing hanger 12 with the pressure release casing hanger running tool 10 as described above locked into the casing hanger 12. The POS-GRIP compression system 22 provides the energy to compress the wellhead housing as described in previous inventions.

In this configuration, the casing hanger running tool 10 will allow the casing hanger 12 to be deployed into the wellhead in preparation for POS-GRIP activation. The casing hanger running tool 10 will be used in conjunction with an indexing mechanism (not shown here) that will provide a means to correctly space out the hanger so that it can be positioned in the flow-by position then re-positioned into the setting position.

This invention could equally be used with a "Type-1" POS-GRIP compression system, as described in previous inventions (not shown here).

Various clamping arrangements may be used with the present invention and some examples of these will be now briefly mentioned below.

One embodiment of a clamping arrangement 22 for the present invention provides a clamp or connector which works by elastically deforming a compression adapter onto an internal tubular portion and specifically onto the inner wellhead casing 14 (e.g. an upper sealing mandrel). The clamping arrangement or connector produces a radial load applied internally by a compression ring 18.

The present invention may operate with a clamping arrangement for sealingly clamping an inner casing to an outer casing. In particular, the clamping arrangement provides a fluid tight seal between an inner casing and an outer casing.

In the clamping arrangement, the compression collar 20 includes outwardly tapered surfaces and, in particular, comprises surfaces which are angled towards a central peak. The clamping arrangement 10 includes a compression ring 18 which locates around the outer surfaces of the compression collar 20. The compression ring 18 includes inwardly tapered surfaces and, in particular, includes two inner surfaces which are oppositely tapered with respect to the surfaces of the collar 20. The inner tapered surfaces of the compression ring 18 are arranged to register and co-operate with the tapered surfaces provided on the compression collar 20.

The clamping arrangement includes movement means or activation means in the form of a plurality of activation bolts 56 which locate with the compression ring 18. The activation bolts 56 are mounted in the compression ring 18 and can be tightened to force and urge the two compression ring components towards each other. The tapered surfaces of the compression ring 18 thereby slide over the tapered surface of the collar 20 and force the collar 20 and the wall of the outer member 16 radially inwardly. The co-operation of the tapered surfaces causes the force generated within the bolts to be transferred to a radial force which urges the inner surface of the compression collar 20 inwardly which thereby forces the wall of the outer member 16 inwardly. The movement of the wall of the outer member inwardly causes the inner clamping surface 17 of the outer member 16 to grip and abut the outer clamping surface 15 of the inner wellhead member 12. In particular, the force is sufficient for the inner wellhead member 12 to be firmly gripped by the outer member 16.

The compression ring 18 and the compression collar 20 have oppositely directed axially tapered annular surfaces so that relative axial movement between the compression collar 20 and the compression ring components produces a reduction in the internal diameter of the unit (in particular the internal diameter of the compression collar 20) to distort the wall of the outer member 16 inwards to grip the diameter of the inner wellhead member 12. The oppositely tapered annular surfaces are angled to provide the required inwards movement (compression/distortion) whilst enabling the movement means to produce the relative movement between the compression ring 18 and the compression collar 20.

It is appreciated that the amount of travel of the compression ring 18 to the activated/locked position together with the angles of the tapers will determine the amount of inward deflection caused by the clamping arrangement 10 and hence the gripping force.

In other embodiments of the clamping arrangement, the compression ring 18 and the compression collar 20 each have one tapered annular surface. In the assembled unit, in use, the compression collar 20 has an outer diameter with a first diameter at an upper end and an outer diameter with a second, greater diameter at a lower end. Similarly, in the assembled unit, the compression ring 18 has an inner diameter with a first diameter at an upper end and an inner diameter with a second, greater diameter at a lower end. The clamping arrangement is arranged to deflect the inner surface of the outer member 16 such that the inner surface of the outer member 16 grips the outer surface 15 of the inner wellhead member 12.

The invention claimed is:

1. A running tool for a casing hanger, the running tool comprising:

securement means to secure a casing hanger to the running tool, the securement means being movable between a secured position in which a casing hanger is secured to the running tool and an unsecured position in which a casing hanger is unsecured to the running tool; wherein, in the secured position, a casing hanger is suspendable from the running tool and the running tool supports a suspension weight of the casing hanger;

activation means in order to enable the securement means to move from a secured position to an unsecured position, wherein the activation means is axially moveable between the secured position and the unsecured position; and release prevention means in order to prevent the movement of the securement means from the secured position to the unsecured position whilst the suspension weight of the casing hanger is suspended from the running tool, in which the release prevention means comprises abutment means to prevent axial movement of the activation means from the secured position to the unsecured position whilst the casing hanger is supported from the running tool and the suspension weight of the casing hanger is being transferred to the running tool;

wherein once the suspension weight is not supported from the running tool, the running tool becomes releasable from the casing hanger; and in which the securement means is retained in the secured position by thrust means, the thrust means comprising thrust pins which are arranged to bear against the activation means and, wherein, the activation means retains the thrust means in the secured position and in which the activation means provide a recess and in which the recess enables the securement means to move from the secured position to the unsecured position.

2. A running tool for a casing hanger according to claim 1 in which the running tool comprises auxiliary release means to activate the release of the casing hanger from the running tool, in which the auxiliary release means comprises anti-rotation means to prevent rotation between the running tool and the casing hanger and the auxiliary release means comprises a rotatable member on the running tool which is rotatable in order to cause the axial movement of the activation means from the secured position to the unsecured position.

3. A running tool for a casing hanger according to claim 1 in which the securement means projects radially outwardly from the running tool and in which the securement means is radially moveable from an outer secured position to an inner unsecured position and in which the activation means is arranged to prevent movement of the securement means from the secured position to the unsecured position and the activation means locks the securement means in a radially projecting position relative to an outer surface of the running tool.

4. A running tool for a casing hanger according to claim 1 in which the securement means comprises a securement member which comprises an annular securement member and wherein the securement member comprises a locking ring and in which the securement member provides an outer engaging surface which is arranged to engage in a corresponding engagement groove provided in the casing hanger and, wherein, the casing hanger provides an engagement groove in an inner surface.

5. A running tool for a casing hanger according to claim 1 in which the recess is axially moveable in the running tool and in which the recess is axially moveable from a secured position at which the thrust means bears against the activation means to an unsecured position at which the thrust means is moveable into the recess and the securement means is radially inwardly moveable.

6. A running tool for a casing hanger according to claim 1 in which the activation means is activated by a downward axial pressure applied to the running tool and, in which, the downward pressure is applied by a fluid located in an annulus located on the upper side of the running tool.

7. A running tool for a casing hanger according to claim 6 in which the pressurised fluid is introduced into the annulus through choke lines located above the running tool.

8. A running tool for a casing hanger according to claim 6 in which the fluid comprises drilling mud.

9. A running tool for a casing hanger according to claim 1 in which the activation means comprises a sleeve member which is axially moveable in the running tool, wherein the sleeve member comprises a collet and, in which, the collet is axially moveable from a secured position to an unsecured position.

10. A running tool for a casing hanger according to claim 9 in which a recess is provided on the collet and the recess is provided on an outer surface of the collet and wherein the recess comprises an annular groove provided on an outer surface of the collet.

11. A running tool for a casing hanger according to claim 1 in which the activation means comprises retaining means to prevent axial movement of the activation means within the running tool and wherein the retaining means may comprise a plurality of retaining members, in which, the retaining members comprise shear pins which are arranged to shear to enable axial the activation means to move from the secured position to the unsecured position, in which the shear pins are arranged to shear in reaction to a pressure applied to the running tool and in which the shear pins are arranged to shear in reaction to a fluid pressure applied within an annulus located on an upper side of the running tool.

12. A running tool for a casing hanger, the running tool comprising:

securement means to secure a casing hanger to the running tool, the securement means being movable between a secured position in which a casing hanger is secured to the running tool and an unsecured position in which a casing hanger is unsecured to the running tool; wherein, in the secured position, a casing hanger is suspendable from the running tool and the running tool supports a suspension weight of the casing hanger;

activation means in order to enable the securement means to move from a secured position to an unsecured position, wherein the activation means is axially moveable between the secured position and the unsecured position; and release prevention means in order to prevent the movement of the securement means from the secured position to the unsecured position whilst the suspension weight of the casing hanger is suspended from the running tool, in which the release prevention means comprises abutment means to prevent axial movement of the activation means from the secured position to the unsecured position whilst the casing hanger is supported from the running tool and the suspension weight of the casing hanger is being transferred to the running tool;

wherein once the suspension weight is not supported from the running tool, the running tool becomes releasable from the casing hanger; and in which the release prevention means is arranged to prevent unintentional activation of the activation means, in which, the release prevention means is arranged to prevent release of the casing hanger prior to the casing hanger being secured within a well bore, and in which the release prevention means comprises abutment means to prevent axial movement of the activation means to the unsecured position and the abutment means prevents the movement of a recess into axial alignment with the securement means.

13. A running tool for a casing hanger, the running tool comprising:

a locking ring that is movable between a secured position in which a casing hanger is secured to the running tool and an unsecured position in which a casing hanger is unsecured to the running tool; wherein, in the secured position, a casing hanger is suspendable from the running tool and the running tool supports a suspension weight of the casing hanger;

a sleeve member axially moveable in the running tool to enable the locking ring to move from a secured position to an unsecured position, wherein the sleeve member is axially moveable between the secured position and the unsecured position; and a first shoulder projecting outwardly from a body of the running tool;

where the sleeve member comprises a collet that is axially movable from a secured position to an unsecured position, a first shoulder projecting inwardly from the collet to abut and engage the first shoulder to prevent axial movement of the sleeve member from the secured position to the unsecured position whilst the casing hanger is supported from the running tool and the suspension weight of the casing hanger is being transferred to the running tool; and wherein once the suspension weight is not supported from the running tool, the running tool becomes releasable from the casing hanger.

* * * * *